United States Patent [19]

Easterwood

[11] 4,269,396

[45] May 26, 1981

[54] WRECKER-HOIST ATTACHMENT FOR TRUCK BED

[76] Inventor: John R. Easterwood, 713 Belt Dr., Grand Prairie, Tex. 75052

[21] Appl. No.: 912,490

[22] Filed: Jun. 5, 1978

[51] Int. Cl.[3] ..... B66C 23/60

[52] U.S. Cl. ..... 254/325; 52/120; 212/177; 414/563

[58] Field of Search ..... 212/8 R, 144, 55, 56, 212/65, 255, 260–263, 177, 187, 188, 266; 254/139.1, 139, 2 R, 4 R, 4 C, 323, 325, 326; 414/563; 52/116–120

[56] References Cited

U.S. PATENT DOCUMENTS

| | | | |
|---|---|---|---|
| 2,157,500 | 5/1939 | Sarsfield et al. | 254/139 X |
| 2,378,605 | 6/1945 | Watson | 254/139.1 |
| 2,503,340 | 4/1950 | Kipper | 212/55 |
| 2,541,970 | 2/1951 | Pospisil | 254/139.1 |
| 2,921,697 | 1/1960 | Holmes, Jr. et al. | 212/144 |
| 3,111,225 | 11/1963 | Miller et al. | 254/139.1 X |
| 3,945,502 | 3/1976 | Diener | 212/144 X |

*Primary Examiner*—Stephen G. Kunin
*Assistant Examiner*—Edmond G. Rishell, Jr.
*Attorney, Agent, or Firm*—Richards, Harris & Medlock

[57] ABSTRACT

A wrecker-hoist combination attachment for mounting on the bed of a truck includes an A-frame having one end supported by the truck bed and the upper apex supported by a support member connected between the apex of the A-frame and the truck bed. The A-frame includes a base bar with a pair of lower legs extending upwardly from and removably engaging the base bar. A midbrace removably engages the upper ends of the lower legs and receives the lower end of a pair of upper legs. A pulley assembly is removably engaged in a first position on the upper ends of the upper legs when the attachment is operated as a hoist. Alternatively, the pulley assembly is engageable in a second position on the upper end of the lower legs with the upper legs and midbrace removed for operation of the attachment as a wrecker. The support member is adjustable in length to support the upper end of the A-frame in both the first and second positions. A winch is mounted to the truck bed for drawing in or letting out a cable which extends over the pulley assembly and downwardly adjacent the end of the rear of the truck bed for engaging loads thereto.

10 Claims, 10 Drawing Figures

WRECKER-HOIST ATTACHMENT FOR TRUCK BED

BACKGROUND OF THE INVENTION

Field of the Invention

The present invention relates to an attachment for mounting on the bed of a truck for converting the truck to a wrecker or hoist unit. More particularly, the present invention relates to an attachment for converting a truck to a hoisting unit when mounted in a first mode or for converting the truck to a wrecker unit when mounted in a second mode.

BACKGROUND OF THE INVENTION

There are many operations that require the assistance provided by a wrecker or hoist unit attached to a vehicle. These include, but certainly are not limited to, operations such as towing of vehicles, lifting of construction or other materials for movement or loading which cannot be lifted by an individual.

In the past, wrecker and hoist units mounted to a vehicle have generally been limited to special purposes vehicles such as wreckers and the like. The structures providing wrecking or hoisting capability have normally been permanently fixed to the vehicle making the vehicle a single purpose unit. Further, such units have been limited to either the capability of acting as a wrecker, with a capability of raising loads to a relatively low height, or as a hoist unit where loads may be elevated to a substantial height.

While certain prior art devices have permitted the conversion of a truck to either a wrecker or hoist unit, these have generally involved substantial modifications to the vehicle requiring extremely complex structures as well as substantial expense. Further, such modifying apparatus has invariably been for the conversion of a pickup truck either to a wrecker unit such as that disclosed in U.S. Pat. No. 3,888,368 to Wallace H. Hawkins, or to a hoist unit permitting elevation of loads to higher levels such as that disclosed in U.S. Pat. No. 2,907,473 to E. V. Garnett.

These units have not been readily mountable on a truck for converting the truck to either or both the wrecker or hoist unit. Further, these units may not be readily disassembled and stored in a compact arrangement when not in use.

Therefore, a need has arisen for a relatively lightweight but sturdy conversion unit for converting a pickup truck to both a wrecker and a hoist unit which may be disassembled by a single individual and stored in a very compact package when not in use.

SUMMARY OF THE INVENTION

The present invention provides a wrecker-hoist combination attachment for mounting on the bed of a truck for converting the truck to either a wrecker unit having a pulley arrangement at a relatively low position or to a hoist unit where the capability of the unit is to elevate loads to a higher position. This is all accomplished by relatively lightweight components which make up a structurally sound unit capable of lifting substantial loads. Further, the unit may be assembled and disassembled by a single individual and when in a disassembled state is readily storable in a compact package.

The wrecker-hoist combination attachment of the present invention includes a frame having a base engageable on the bed of a truck with a pair of lower legs extending upwardly from and removably engaged on the base. A midbrace is removably mounted on the upper end of the lower ends and receives the lower end of a pair of upper legs. A pulley assembly is engageable in a first position on the upper end of the upper legs for operation as a hoist. Alternatively, the pulley assembly may be engaged in a second position on the upper end of the lower legs with the upper legs and midbrace removed. In this configuration, the attachment operates as a wrecker. A support is pivotally connected at one end to the pulley assembly and at a second end to the truck bed to support the upper portion of the frame from the truck.

In accordance with one embodiment of the invention, the frame base includes a bar having spaced receiving tubular feet extending upwardly therefrom for receiving the lower legs therein. A stabilizing line is attached at one end to the base and at the opposite end to the pulley assembly. A tensioning device, such as a boomer, is attached along the line to draw the pulley assembly toward the base thereby stabilizing the unit.

In accordance with another embodiment of the invention, the support member is adjustable in length to permit adjustment of the upper end of the frame relative to the truck bed. In accordance with still a further embodiment of the invention, the upper and lower legs are tubular in cross section and the midbrace includes a pair of tube sections joined by a space bar, said tube sections adapted to receive the lower end of the upper legs and the upper end of the lower legs therein.

In accordance with another embodiment of the invention, a winch is attached to the truck having a line extending therefrom over the pulley assembly and extending downwardly therefrom for engagement to a load to be carried by the wrecker-hoist attachment.

In accordance with another embodiment of the invention, the wrecker-hoist combination attachment may be mounted on other vehicles, such as a trailer or the like.

DETAILED DESCRIPTION OF THE DRAWINGS

For a more complete understanding of the invention and for further details and advantages thereof, reference is now made to the following description taken in conjunction with the accompanying drawings in which.

DESCRIPTION OF THE PREFERRED EMBODIMENT

The present invention provides a unit attachable to the bed of a truck for converting the truck to a hoist unit, capable of elevating loads to substantial heights, or alternatively to a wrecker.

Figure 1:
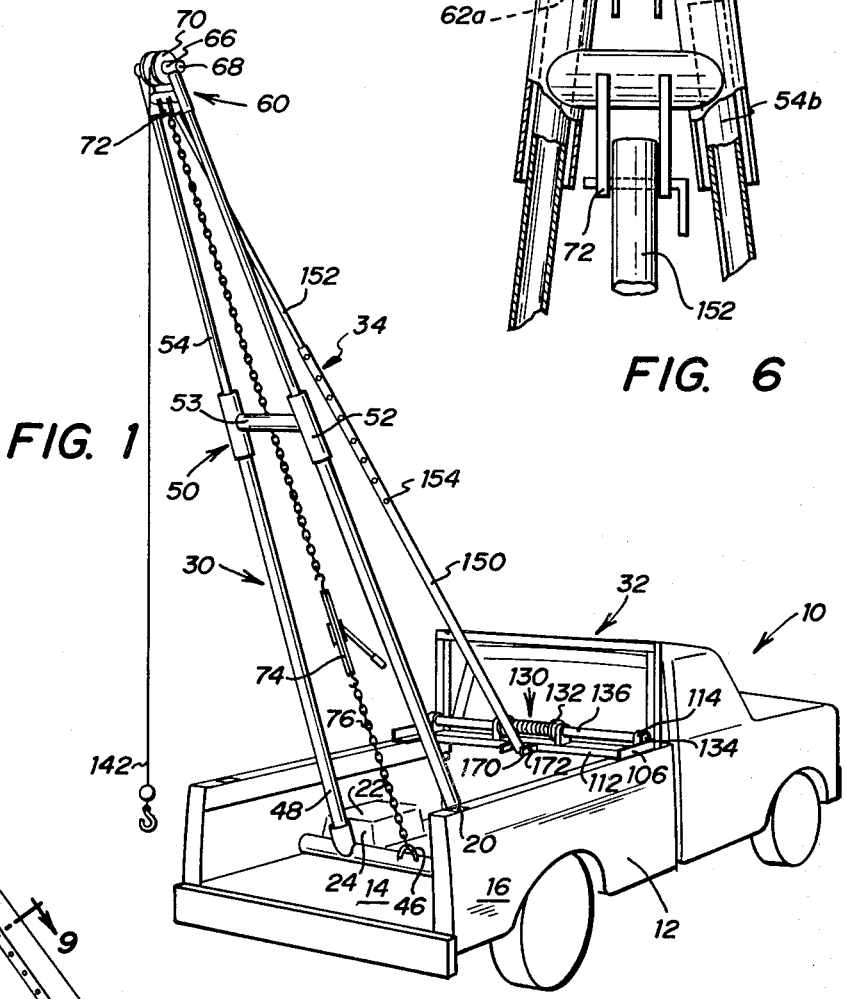
FIG. 1 is a perspective view of the attachment of the present invention mounted on the bed of a truck and in the hoist mode.
Figure 2:
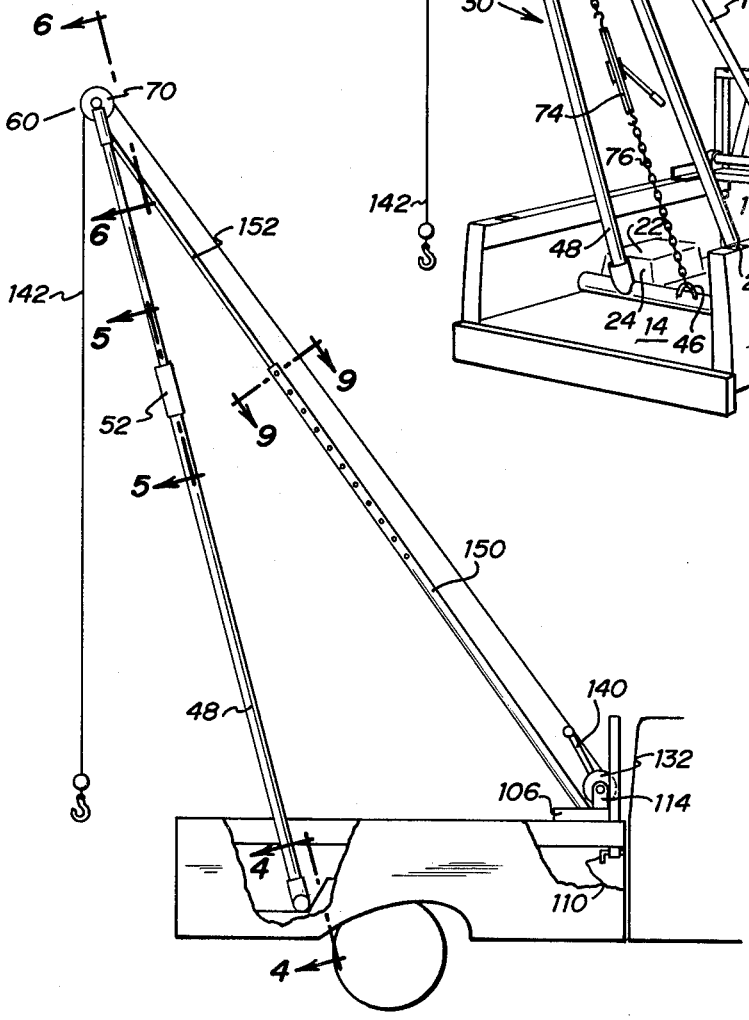
FIG. 2 is a side elevation of the attachment illustrated in FIG. 1.

Referring to FIGS. 1 and 2, the present invention is mountable to a truck of the type having a passenger cab 10 with a rear bed 12 mounted rearwardly of cab 10. The bed of the truck has a floor 14 with side walls 16 extending upwardly therefrom and a forward wall 18 attached from the bed floor 14 adjacent cab 10. Walls 16 are normally formed with stake pockets 20 which extend vertically into the bed side walls spaced along the length thereof. Wheel boxes 22 extend upwardly from floor 14 immediately over the wheel area and have a rearwardly facing wall 24.

Figure 3:
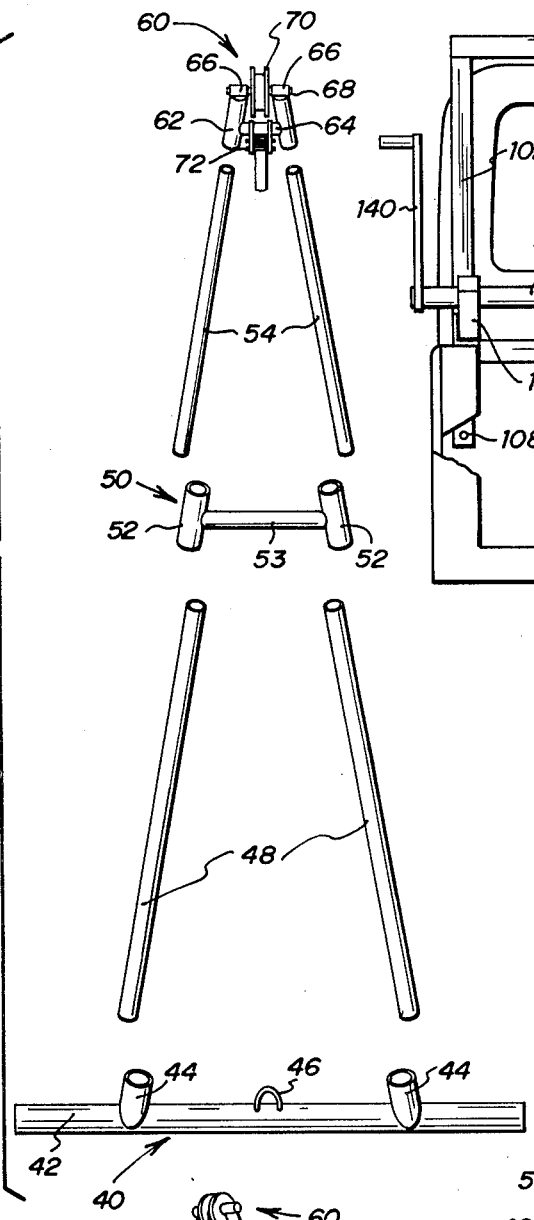
FIG. 3 is an exploded rear view of the A-frame assembly of the apparatus illustrated in FIG. 1.
Figure 7:
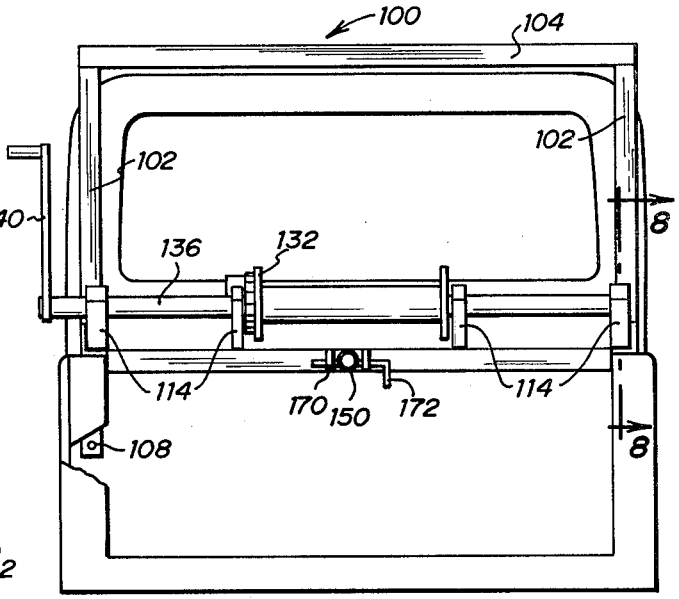
FIG. 7 is a rear view of the winch mechanism of the present invention.

The attachment forming the present invention includes an A-frame assembly 30, a head rack and winch assembly 32 and an adjustable support member 34 mounted between the A-frame assembly 30 and the head rack and winch mount assembly 32. Referring to FIGS. 1, 2, and 3, A-frame assembly 30 includes a base 40 made up of a tubular section 42 with a pair of spaced tubular receiving feet 44 attached thereto, such as by welding. An attachment hook 46 is also mounted to the upward side of tubular section 42. A pair of lower legs 48 are slidably received into tubular feet 44 and normally rest against tubular section 42.

A midbrace assembly 50 includes a pair of sleeves 52 joined by a connecting bar 53. Sleeves 52 are angled slightly inwardly as are feet 44 attached to tubular section 42. A pair of upper tubular legs 54 are slidably engaged within sleeves 52 of midbrace 50. A pulley assembly 60 is mounted on the upper ends of upper legs 54. Pulley assembly 60 includes a pair of the sections 62 spaced slightly from each other by a cross member 64. The upper ends of tube sections 62 have sleeves 66 attached thereto for receiving a pulley shaft 68 therein. A pulley 70 is mounted on shaft 68 for rotation thereabout. Attachment plates 72 are mounted from cross member 64 and extend downwardly therefrom.

Figure 4:
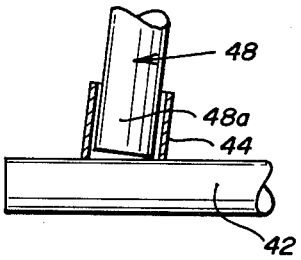
FIG. 4 is a section view taken along line 4—4 of FIG. 2.
Figure 5:
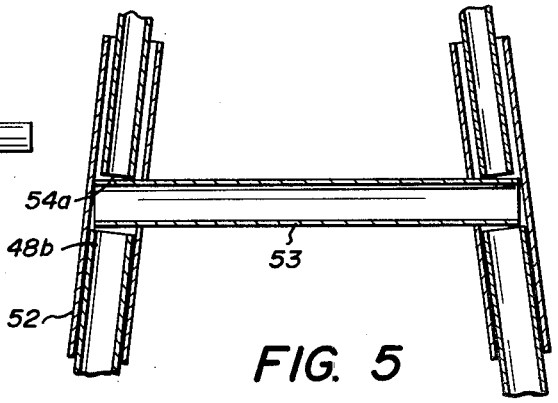
FIG. 5 is a section view taken along line 5—5 of FIG. 2.

When in the assembled position shown in FIGS. 1 and 2, a boomer 74 and chain 76 are attached between hook 46 and plates 72 to draw pulley assembly 60 toward base 40 to maintain the components of the A-frame in an assembled relationship. As is shown in FIGS. 1 and 2, each of the components described is assembled one to the other by merely inserting the lower legs 48 into tubular feet 44 of base 40, the insertion of sleeves 52 of midbrace 50 over the upper ends of legs 48, the insertion of the lower ends of upper legs 54 into sleeves 52, and the insertion of tubular section 62 of pulley assembly 60 over the upper ends of upper legs 54. Referring to FIG. 4, the engagement of lower end **48*a* of lower leg 48 is inserted within tubular foot 44 and engages the upper surface of tubular section 42. Referring now to FIG. 5, connecting bar 53 is attached to sleeves 52 by engagement through the walls of sleeves 52 until the ends of bar 53 engage the outer facing sides of sleeves 52. In this arrangement, the upper end 48*b* of lower legs 48 engages bar 53 while the lower end 54*a* of upper leg 54 engages the opposite side of bar 53** when the A-frame is assembled.

Figure 6:
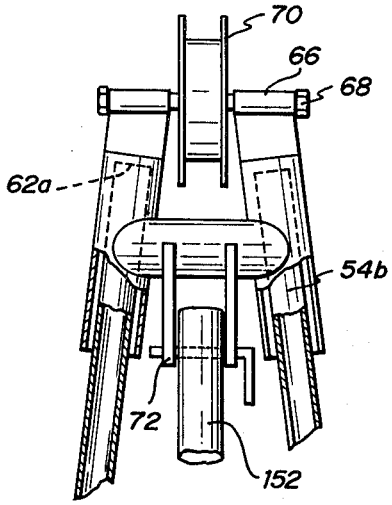
FIG. 6 is a section view taken along line 6—6 of FIG. 2.

As is shown in FIG. 6, the upper end **54*b* of upper leg 54 is mountable within tubular sections 62 of pulley assembly 60 and engages end wall 62*a*. Midbrace 50 with upper legs 54 serve as a height extension member by extending pulley assembly 60 well above the upper end of lower legs 48**.

In a preferred embodiment of the invention, A-frame assembly 30 is mounted in the bed of the pickup by resting tubular section 42 of base member 40 on bed floor 14 immediately against rearwardly facing wall 24 of wheel boxes 22. While base member 40 may be bolted to the truck bed or frame therebelow, in the preferred embodiment of the invention, A-frame 30 merely rests on floor 14 against wall 24 of wheel boxes 22.

Referring again to FIGS. 1 and 2, head rack and winch assembly 32 includes an over the cab frame 100 including vertical legs 102 with an upper horizontal bar 104 connected between the upper ends of legs 102. A pair of inwardly facing angles 106 are attached, as by welding, to the rearwardly facing side of legs 102 intermediate of the ends of legs 102. The portion of legs 102 below angles 106 are inserted in stake pockets 20 and have an aperture 108 through the lower end thereof for receiving a safety pin 110. With the lower portion of legs 102 inserted in stake pockets 20, and with safety pin 110 engaged in aperture 108 below stake pockets 20, head frame 100 is secured to side wall 16 of bed 12. Further, with the lower portion of legs 102 inserted into stake pockets 20, angles 106 rest on the upper surface of side walls 16.

Figure 8:
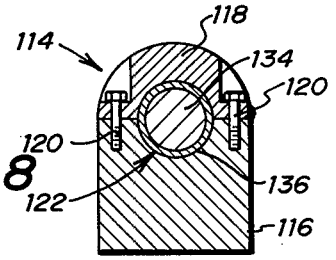
FIG. 8 is a section view taken along line 8—8 of FIG. 7.

A cross bar 112 is joined between angles 106 and side legs 102. Cross bar 112 supports four spaced shaft supports 114. Referring to FIG. 8, shaft supports 114 include a lower block 116 with an upper cap 118 mountable thereon by bolts 120 to form an aperture 122 therethrough.

A winch assembly 130 is mounted on shaft supports 114. Winch assembly 130 includes a drum 132 fixedly attached to a shaft 134 extending from both ends of drum 132. A bearing sleeve 136 is mounted over shaft 134 and seated on blocks 116 of shaft supports 114 and held in position by caps 118. Shaft 134 rides within sleeve 136. A hand crank 140 is attached to shaft 134 for rotating drum 132. A cable 142 is normally wound onto drum 132 and extends from drum 132 over pulley 70 and extends off the end of truck bed 12 for engagement of loads on hook 144.

Figure 9:
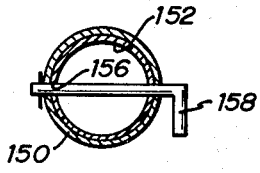
FIG. 9 is a section view taken along line 9—9 of FIG. 1.

Adjustable support member 34 is connected between bar 112 of head rack and winch assembly 32 and pulley assembly 60. Support member 34 includes a lower tubular section 150 and an upper tubular section 152 which telescopes into and out of section 150. Both sections 150 and 152 have apertures 154 and 156, respectively, therein (FIGS. 2 and 9). By aligning apertures 154 of section 150 with aperture 156 of section 152 and inserting a pin 158 therethrough, the relationship of the two sections may be fixed (FIG. 9). Section 152 may be extended relative to section 150 by merely disengaging pin 158 and withdrawing section 152 for alignment of other apertures 154 with aperture 156 and engagement of pin 158 therethrough.

The lower end of section 150 is engaged to bar 112 by connection to plates 170 extending from bar 112 and pin 172 for insertion through apertures in plates 170 and through the lower end of section 150. A similar connection is made between the upper end of section 152 and plates 72 on pulley assembly 60 providing for a pivotal attachment between the upper end of section 152 and pulley assembly 60.

The angular relationship of A-frame assembly 30 may be altered by telescoping or drawing in section 152 into section 150. By lengthening support member 34 through extending section 152 out of section 150, pulley assembly 60 of A-frame assembly 30 is lowered. Shortening the length of support member 34 by withdrawing section 152 within section 150 raises pulley assembly 60.

In the configuration illustrated in FIGS. 1 and 2, the pulley assembly is positioned at a significant height above the bed of the truck and is readily operable, with cable 142 extended over winch assembly 130 for drawing in and letting out the cable, to act as a hoisting device for raising and lowering objects to substantial heights. As can be appreciated in view of the above disclosure, the components of the A-frame assembly 30 are maintained in an assembled relationship by boomer 74 and chain 76 which draws each of the components into an assembled relationship. Further, the A-frame assembly 30 retains its position on the bed of the truck without any attachment structure by the action of gravity on the components of the unit or by reaction to a load carried on cable 142. Further, as a result of the incline of the A-frame assembly with the pulley assembly extending over the end of the truck bed, the forces applied by the base of the A-frame against the truck bed are downwardly and toward the wheel box thereby maintaining the base of the A-frame in contact with the truck bed floor and the rearward face of the wheel box. Further, these forces tending to seat the A-frame base against the bed of the truck and the rearwardly facing wall 24 of wheel box 22 are increased when load is engaged on cable 142. Lateral stability of the A-frame is assured by the separation of the lower legs at their point of connection to tubular section 42.

Figure 10:
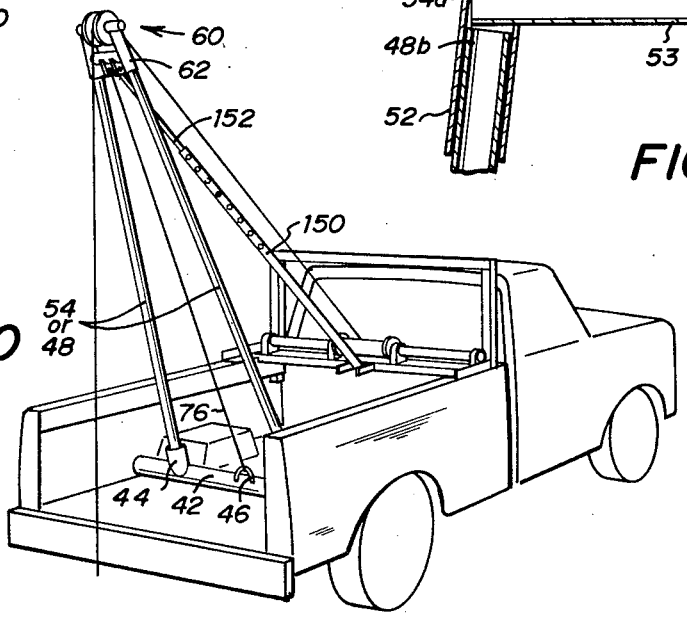
FIG. 10 is a perspective view of the attachment of the present invention in the wrecker mode.

In many lifting operations, it is not necessary to have a high lift capability. The present invention is readily adaptable to these situations by merely removing upper legs 54 and midbrace 50 with the engagement of pulley assembly 60 directly to the upper ends of lower legs 48. This configuration is illustrated in FIG. 10 where it is shown that boomer 74 and chain 76 are likewise used in this embodiment to maintain the components of A-frame assembly 30 in an assembled relationship. Support member 34 is also adjustable to position pulley assembly 60 in its lower position in the arrangement illustrated in FIG. 10 by merely drawing section 152 into section 150 of support member 34.

The transformation of the A-frame assembly from the mode illustrated in FIGS. 1–9 to the mode illustrated in FIG. 10 is accomplished without any tools whatsoever, and only requires the disengagement of boomer 74 to allow pulley assembly 60 to be removed from upper legs 54. Subsequent thereto, legs 54 and midbrace 50 are removed from lower legs 48 and pulley assembly 60 is engaged directly on the upper ends of lower legs 48. Tubular feet 44 provide sufficient clearance to allow lower legs 48 to be drawn inwardly at their upper ends to engage tubular sections 62 of pulley assembly 60. Likewise, tubular sections 62 provide sufficient clearance to receive the upper ends of lower legs 48 at an incline other than along the longitudinal axis of tube sections 62.

With pulley assembly 60 positioned in the lower mode illustrated in FIG. 10, the attachment structure is operable as a winch being capable of lifting greater loads than when in the configuration illustrated in FIGS. 1 through 9. This greater capability is a result of shorter component arms making up A-frame assembly 30.

Alternatively, lower legs 48 and midbrace 50 may be removed and the lower ends of upper legs 54 engaged in tubular feet 44 of base 40. Where upper legs 54 are shorter than legs 48, this arrangement positions pulley assembly 60 in a third position relative to truck bed 12. Thus, pulley 70 may be positioned at one of three heights depending on its arrangement of the components of the present invention.

In an operation of the invention, hand crank 140 is operated to rotate drum 132 to let out or take in cable 142 as desired. A ratchet dog 180 is pivotally attached from vertical legs 102 and is biased against a ratchet wheel 182 attached to drum 132. This ratchet dog engages ratchet wheel 182 to prevent cable 142 from being inadvertently let out.

The attachment may be disassembled and removed completely from the truck by simply detaching support member 34 from pulley assembly 60. It will be appreciated that the A-frame assembly 30 is composed of only 7 components, namely base 40, lower legs 48, midbrace assembly 50, upper legs 54 and pulley assembly 60. Support member 34 consists of only two components, namely upper and lower sections 152 and 150, respectively. These components are easily disassembled, and in particular the A-frame assembly which employs no pins or bolt attachments but rather is held in an assembled relationship only by boomer 74. When disassembled, the components may be easily stored in a very compact package.

With A-frame assembly 30 removed from the bed of the truck, head rack and winch assembly 32 may be used independently of the A-frame assembly. Rack and winch assembly 32 may be removed completely from the truck by merely removing pins 110 from the lower portion of legs 102 and withdrawing the assembly from the truck bed. Alternatively, the winch assembly 130 may be removed by merely removing caps 118 from lower blocks 116 and dismounting drum 132, shaft 134 and sleeves 136.

Thus, the present invention provides a wrecker-hoist combination attachment for mounting on the bed of a truck for converting the truck to either a wrecker unit having a pulley assembly at a relatively low position or to a hoist arrangement where the unit is capable of elevating loads to a higher position. This is all accomplished by relatively lightweight components which make up a structurally sound unit capable of lifting substantial loads. Further, the unit may be assembled and disassembled by a single individual without tools and when in a disassembled state is readily storable in a compact package.

Although preferred embodiments to the invention have been described in the foregoing detailed description and illustrated in the accompanying drawings, it will be understood that the invention is not limited to the embodiments disclosed, but is capable of numerous rearrangements, modifications, and substitutions of parts and elements without departing from the spirit of the invention. For example, the attachment of the present invention may be mounted on other vehicles such as a trailer or the like. Thus, the present invention is intended to encompass such rearrangements, modifications, and substitutions of parts and elements as fall within the scope of the appended claims.

What is claimed is:

1. An attachment for converting a truck having a hauling bed with wheel boxes extending upwardly therefrom to a wrecker-hoist combination, comprising:

a frame having a base including a bar having spaced receiving tubular feet extending upwardly therefrom, said bar being engageable on the bed of the truck for unattached abutment against the rearward face of the wheel boxes, a pair of lower legs extending upwardly from and removably engaged within the tubular feet extending from the bar of said base, a pulley assembly including a pulley with a pair of tubular receiving members engageable in a first position wherein the upper end of the lower legs are received within the tubular receiving members of said pulley assembly to form an A-frame, a height extension member mountable between the pulley assembly and the lower legs to position the pulley assembly in a second position further raised above the base than in the first position, said height extension member including a midbrace having tubular sleeves joined in a spaced relationship by a connecting bar and a pair of upper legs engageable in the sleeves and extending upwardly therefrom for engagement into the receiving members of said pulley assembly, said height extension being engaged to said lower legs by engaging the sleeves of said midbrace onto the upper ends of said lower legs, the sleeves of said midbrace being separated by a greater distance than the tubular receiving members of said pulley assembly to provide an A-frame configuration when said height extension is used, the inside diameter of the tubular feet of said base permitting the angular movement of said lower legs from a first position where the upper ends of said lower legs are inserted into said pulley assembly to a second position wherein the upper ends of said lower legs are inserted into the sleeves of said midbrace, and a support member pivotally connected at one end to the pulley assembly and at the second end to the truck bed to support the frame from the bed.

2. The attachment according to claim 1 further comprising:

a tensioning line attached at one end to the base of said frame and at the opposite end to said pulley assembly, and means for tensioning said line to draw said pulley assembly toward the base.

3. The attachment according to claim 1 wherein said support member is adjustable in length to permit angular adjustment of said frame relative to the truck bed.

4. A wrecker-hoist combination attachment for mounting on a bed of a truck, comprising:

a base including a bar having spaced receiving tubular feet extending upwardly therefrom, said bar being nonattachably engaged on the bed of the truck, a pair of lower legs extending upwardly from and removably engaged within the tubular feet extending from the bar of said base, a midbrace having tubular sleeves joined in a spaced relationship by a connecting bar and receivable on the upper ends of said lower legs, a pair of upper legs engageable in the sleeves of the midbrace for extending upwardly therefrom, a pulley assembly including a pulley with a pair of tubular receiving members extending therefrom, said tubular members being spaced more closely than the sleeves of said midbrace, and said midbrace sleeves being spaced more closely than the tubular feet of said base, said pulley assembly being removably engageable in a first position on the upper end of said upper legs and alternatively removably engageable in a second position on the upper ends of the lower legs with the upper legs and midbrace removed, the inside diameter of the tubular feet of said base permitting the angular movement of said lower legs from a first position where the upper ends of said lower legs are inserted into said pulley assembly to a second position wherein the upper ends of said lower legs are inserted into the sleeves of said midbrace, and a support member pivotally connected at one end to the pulley assembly and at the second end to the truck to support said pulley assembly relative to the truck.

5. The wrecker-hoist combination attachment according to claim 4 wherein the base of said frame receives the lower end of the upper legs with the midbrace and lower legs removed to position the pulley assembly in a third position relative to the vehicle.

6. The wrecker-hoist combination according to claim 4 further comprising:

a stabilizing line attached at one end to the base of said frame and at the opposite end to the pulley assembly, and means for tensioning said line to draw the pulley assembly toward the base.

7. The wrecker-hoist combination according to claim 4 wherein said support member is adjustable in length to permit angular adjustment of said frame relative to the bed of the truck.

8. The wrecker-hoist combination according to claim 4 wherein said upper and lower legs are tubular.

9. The wrecker-hoist combination attachment according to claim 4 further comprising:

a winch attached to the vehicle having a line extending therefrom over the pulley assembly and extending downwardly therefrom for engagement to a load to be carried by the attachment.

10. The wrecker-hoist combination according to claim 4 wherein the inside diameter of the tubular receiving members of said pulley assembly is greater than the outside dimension of said upper ends of said upper and lower legs to permit insertion of said upper legs therein having a first angular position or the lower legs therein having a second angular position.

* * * * *